United States Patent [19]

Hopley et al.

[11] Patent Number: 4,458,947

[45] Date of Patent: Jul. 10, 1984

[54] MINING METHOD

[75] Inventors: Robert J. Hopley, Germiston; Wynand J. van der Westhuizen, Boksburg, both of South Africa

[73] Assignee: Boart International Limited, Johannesburg, South Africa

[21] Appl. No.: 283,277

[22] Filed: Jul. 14, 1981

[30] Foreign Application Priority Data

Jul. 17, 1980 [ZA] South Africa ..... 80/4312

[51] Int. Cl.[3] ..... E21C 41/00

[52] U.S. Cl. ..... 299/11

[58] Field of Search ..... 299/11, 18, 1; 405/258

[56] References Cited

U.S. PATENT DOCUMENTS 3,167,354 1/1965 Macaul et al. ..... 299/18 X 3,578,807 5/1971 Barrett ..... 299/1

4,309,059 1/1982 Walsh ..... 299/11

FOREIGN PATENT DOCUMENTS 989686 4/1965 United Kingdom .

1128390 9/1968 United Kingdom .

*Primary Examiner*—Ernest R. Purser

*Attorney, Agent, or Firm*—Lowe, King, Price & Becker

[57] ABSTRACT

A deep level mining method wherein conventional mining takes place to recover ore and pillars are left for support purposes. The ore in the pillars is recovered before or after their formation by drilling overlapping holes into the reef in the pillars.

The holes are plugged thereafter to restore the supporting function of the pillars.

10 Claims, 6 Drawing Figures

MINING METHOD

BACKGROUND OF THE INVENTION

This invention relates to a method of mining.

In deep level mining the removal of rock generates considerable stress, resulting in rock bursts and rock falls. These disturbances result in a loss of production and more unfortunately in fatalities. It is therefore of vital importance to reduce rock stresses and, one way in which this is done, is to leave pillars of unmined rock in an area mined by conventional techniques.

The pillars are necessarily of considerable dimensions, and, as they are traversed by unmined reef, they represent a substantial loss of valuable ore.

SUMMARY OF THE INVENTION

It is an object of the present invention to provide a method of mining wherein a considerable portion of ore in the pillars can be recovered without significantly detracting from the stabilizing properties of the pillars.

The invention provides a method of mining wherein one is mined leaving a plurality of supporting pillars, the ore in each of the pillars having been recovered by drilling a series of holes therein.

Further according to the invention the method includes the step of utilizing guide means to drill each hole so that it overlaps, and does not run into, an adjacent previously drilled hole. In one form of the invention the ore in at least some of the pillars is recovered after formation of the pillars. However in a preferred form of the invention the ore is recovered from the pillars before their formation. This may be effected by demarcating the pillars on a rock face and by drilling a series of holes into each of the demarcated pillars to recover the ore contained therein. Subsequently the rock face is mined to form the pillars.

Also according to a preferred feature of the invention the holes in each pillar are drilled obliquely to its face. This carries with it the surprising advantage, determined by research studies, that the stability of the mined pillar is increased if, instead of drilling the holes normal to its face, the holes are drilled obliquely to its face.

In order to restore the stabilizing or supporting function of each pillar the method includes the step of plugging at least some of the holes in each pillar by suitable means.

It is of prime importance to minimize costs and ensure optimum ore recovery to drill the holes with considerable accuracy so that they do not traverse barren rock. Thus in accordance with the invention the holes are drilled in directions determined by sensing means located in previously drilled holes which monitor the distribution of the ore.

Also in accordance with the invention a circulating flushing water system is employed while drilling the holes and ore is recovered from the system with the aid of a suitable recovery device.

In one form of the invention, where the holes are to be drilled over relatively long distances, the drilling is effected by means of a low profile, high pressure, down the hole drill machine equipped with button bits. This type of machine has a greater efficiency than conventional drilling machines and the drilled material is in the form of chips or cuttings which are susceptible to separation into fractions by centrifugal or gravitational means such as settlers or cyclone systems respectively. This enables the detritus to be readily treated underground and avoids transportation to the surface of dross. Alternatively as the value of the detritus is high the treatment operation may be carried out on surface.

BRIEF DESCRIPTION OF THE DRAWINGS

The invention is further described by way of example with reference to the accompanying drawings in which.

DESCRIPTION OF PREFERRED EMBODIMENT

Figure 1:
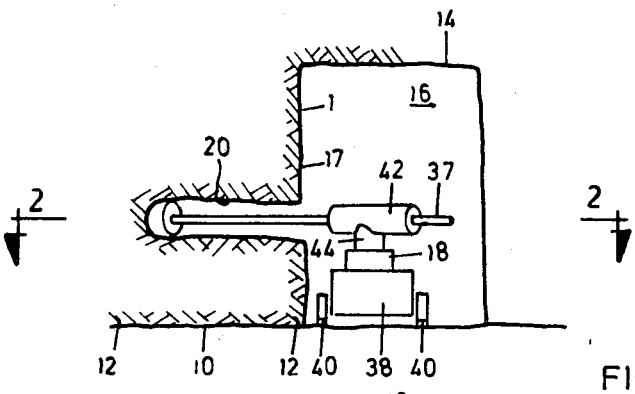
FIG. 1 is a side view of an embryo pillar in the process of being drilled.

In the drawings, the working face of a stope is marked 10.

Figure 4:
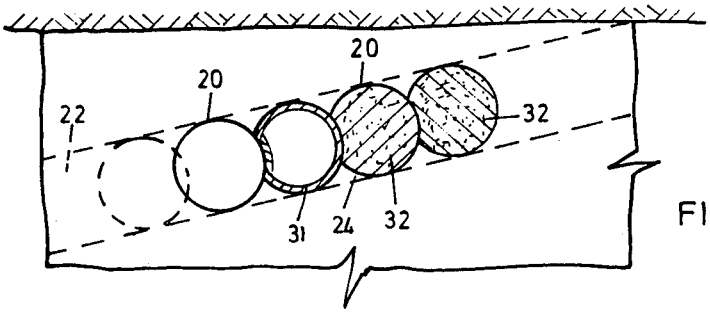
FIG. 4 is a fragmentary view of a pillar in the process of being drilled.

In the preferred form of the invention the face is demarcated to show where the supporting pillars for a hanging wall 14 will be located. In the initial stage an access area 16 is excavated, one face 17 of which will be a face of the embryo pillar demarcated at 12. The area is wide enough to accommodate drilling equipment, generally indicated at 18 which will be used in excavate a series of holes 20 to mine at least a substantive part of the reef 22 that traverses the embryo pillar. The holes may be spaced apart, but, to enable recovery of the maximum possible amount of reef, they are overlapped, as is seen in FIG. 4, so that the final drilling pattern is a scalloped slot 24. The degree of overlap varies according to the physical characteristics of the reef and is determined inter alia by the thickness of the reef, its value, the cost of drilling etc.

Figure 3:
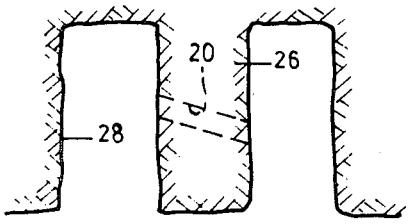
FIG. 3 is a plan view illustrating the stage in which the pillar has been formed and drilling is about to commence on the next embryo pillar.

The drilling having been completed to remove as much of the reef from the embryo pillar as is practicable, mining is continued, in the course of which the drilled partly formed pillar 26 is left isolated, as is seen in FIG. 3. The operation has exposed a face 28 of an adjacent, still embryo, pillar, which is drilled and in due course isolated; and so on.

Figure 5:
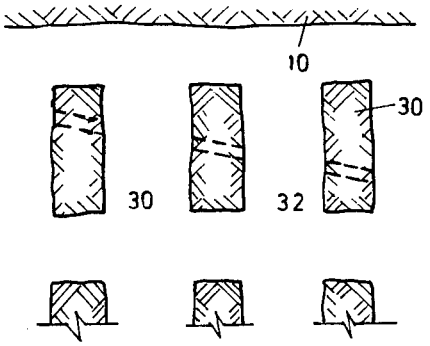
FIG. 5 is a plan view of the rock face about to be mined, and of supporting pillars for the hanging adjacent the face.

It is possible that mining is conventional in that the rock is excavated, leaving a series of supporting pillars 30, as seen in FIG. 5.

The necessary precautions are taken to ensure that the hole being drilled does not run-off into its predecessor. This is achieved, for instance, by inserting a sector 31 (FIG. 4) into the previously drilled hole to provide a wall to obturate the hole in the party wall between the hole being drilled and its predecessor, or by a cylindrical plug that forms part of the drill rig and is located within a drilled hole to maintain the drill parallel with it while the next hole is being drilled. Any suitable guide may of course be used.

It is essential to ensure that the pillars fulfil their function of supporting the hanging wall, and this may be impaired even though the series of holes is discontinued to leave undrilled marginal zones, a procedure which, in any event, would limit the amount of reef recovered. An alternative, and preferred, course is to plug at least some of the holes to restore the strenght of the pillar.

The plug 32 may consist of a cementitious grout or similar settable material pumped into the hole, or a preformed plug driven into the hole. The plugging may be effected, especially in the case of the drilling of embryo pillars, after the series of holes has been completed, or, and this is applicable particularly to the drilling of formed pillars, as drilling proceeds, precautions being taken in the case of a grout, to prevent access of grout to the hole being drilled and its immediate predecessor. An alternative procedure is to plug each hole after it has been dug with a plug of crescent shape, the wall of the missing sector of the crescent forming part of the circumference of the next hole to be drilled. This device therefore serves the twin purposes of preventing run-off of the drill and plugging the preceding hole.

A further alternative is to insert a cylindrical plug into the hole after it has been drilled, with the face flush with the rock face, so that the next hole is drilled mainly in the rock and partly in the plug. Where the hole is deep, the plugs would, of course, be made in sections which are fed progressively into the hole to plug it. Only a very small portion of the pillar cross-section is then left unsupported over open holes at any time.

Figure 2:
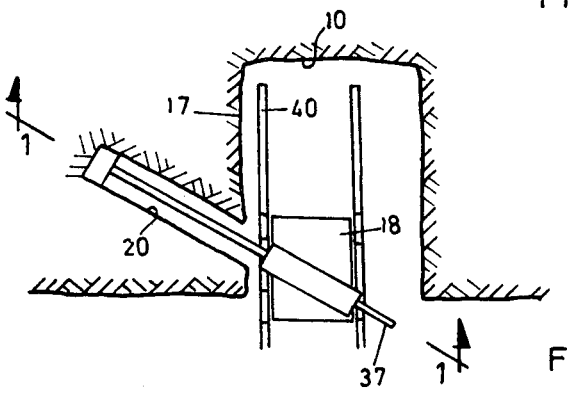
FIG. 2 is a horizontal section on the line 2—2 of FIG. 1.

Research indicates that the stability of the mined pillar may be increased if, instead of drilling the holes normal to the face 17 of the pillar, the holes are drilled obliquely to the face, as is shown in FIG. 2.

To ensure maximum recovery of ore from the pillars, care is taken to direct the holes according to the dip of the reef and to follow changes in reef direction. To this end, use is made of means such as an optical down the hole periscope or other suitable sensing means which is lowered into the hole periodically, to monitor the reef and to orientate the drill accordingly.

As has been pointed out, the drilling is preferably done by means of a "down the hole" drill or other non-coring drill. This is preferably a low-profile, high pressure drill, where the holes are deep. This necessitates the presence of means to support the drill rods 37 outside the hole being drilled. This means may consist of a carriage 38 on rails 40, to enable it to traverse the pillar as the drilling of the sequence of holes proceeds, and a rig 42 on the carriage to support the drill rod line. In order to enable the drill to be orientated in accordance with the instructions of the periscope, the rig is mounted on a hydraulic jack to vary its height relatively to the chassis and its inclination of the reef.

For shorter holes or for small diameter holes, a high pressure conventional percussion drill may be used with the normal coolant and flushing medium e.g. water. The method of the invention is not, of course, tied to the use of any particular drill. For instance a high performance non-coring diamond drill may be used.

The use of a high pressure "down the hole" drill permits the drilling to be done at a rate of the order of some 10 to 40 meters per hour, and it is pointed out that this operation does not hinder the mining of the stope face which proceeds unhindered.

Apart from the known advantages of high pressure drilling as compared with conventional drilling in the method of the invention, it has the large benefit that the detritus, flushed out by the water stream, is in the form of chips and no dust-forming powder. Not only, then, is the dust hazard minimised, but the chips are more readily collected than the sludge of conventional drilling, more readily stored, and, what is more important still, are more easily treated for sizing or the separation of gangue. According to one feature of the invention, the sizing or separation is done in situ or at least underground by means such as a cyclone 46 (FIG. 6) and the valuable fraction only is transported to a treatment plant 48 which may also be located underground.

Figure 6:
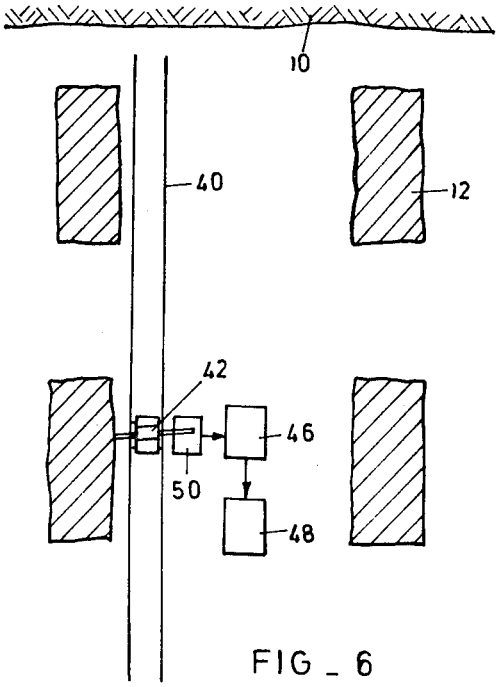
FIG. 6 is a flow sheet of the mining system of the invention, in one of its forms.

The block 50 in FIG. 6 is intended to represent some means whereby detritus from the drill is gathered for discharge to cyclone 46. Such means may, for instance, consist of a flue or chute at the mouth of the hole being drilled beeding detritus to a collector unit; or alternatively a hopper into which the detritus is loaded or a conveyor belt that is located to receive the detritus for onward transport.

The invention should be constrasted to the mining method disclosed in the specification of British Patent No. 989,686. This patent teaches a mining method wherein substantially all the ore is recovered by drilling overlapping parallel holes. In other words conventional mining techniques play only a small role in respect of the ore recovery. In the present invention on the other hand conventional mining techniques are employed where possible and it is only because of the requirements of deep level mining which demand remnant pillar techniques that drilling is resorted to in order to recover the ore contained in the pillars. The invention thus minimises the need for drilling whilst simultaneously taking into account the safety requirements and so provides an economically effective mining method.

We claim:

1. A deep level ore mining method comprising the steps of:

(a) excavating an access area of sufficient size to receive drilling equipment, said access area defining an overhead hanging wall and a generally vertical rock face;

(b) demarcating portions of the rock face;

(c) drilling one or more holes spaced from each other in each said demarcated portion to recover ore contained therein;

(d) substantially filling at least some of said holes; and (e) mining the rock face about each demarcated portion to recover ore between adjacent demarcated portions, utilizing mining techniques wherein a major part of the ore between the demarcated portions is recovered without drilling so that said demarcated portions are formed as free standing pillars unsupported along all vertically extending faces thereof, said pillars being of sufficiennt strength to avoid collapse thereof after mining operations cease.

2. A method acccording to claim 1, including the further step of utilizing guide means to drill each hole so that it overlaps, and does not run into, an adjacent previously drilled hole.

3. A method according to claim 1 wherein ore inat least some of the pillars is recovered after formation of the pillars.

4. A method according to claim 1 wherein ore in at least some of the pillars is recovered before their formation by demarcating the pillars on a rock face and drilling the series of holes into each of the demarcated pillars, and subsequently mining the rock face to form the pillars.

5. A method according to claim 1 wherein the holes in each pillar are drilled obliquely to its face.

6. A method according to claim 1 wherein the holes are drilled in directions determined by sensing means located in previously drilled holes to monitor distribution of the ore.

7. A method according to claim 1 wherein the holes in said pillar are drilled by means of a high pressure, down the hole hammer machine.

8. A method according to claim 1 wherein a circulating flushing water system is employed while drilling the holes and ore is recovered from the system with the aid of a recovery device.

9. The method of claim 1, wherein said adjacent pillars are formed so that the spacing therebetween is at least as great as the thickness of each said pillar.

10. The method of claim 1, wherein each hole is drilled obliquely and extends in a generally horizontal plane.

* * * * *